US006629747B1

(12) United States Patent
King et al.

(10) Patent No.: US 6,629,747 B1
(45) Date of Patent: Oct. 7, 2003

(54) METHOD FOR DETERMINING INK DROP VELOCITY OF CARRIER-MOUNTED PRINTHEAD

(75) Inventors: David G. King, Shelbyville, KY (US); Patrick L. Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/175,972

(22) Filed: Jun. 20, 2002

(51) Int. Cl.[7] ..... B41J 29/393; B41J 25/308

(52) U.S. Cl. ..... 347/19; 347/8

(58) Field of Search ..... 347/19, 14, 16, 347/8–9, 6–7, 10–12, 47, 37; 358/504, 400

(56) References Cited

U.S. PATENT DOCUMENTS

| | | | | |
|---|---|---|---|---|
| 4,045,770 | A | | 8/1977 | Arnold et al. |
| 4,167,013 | A | | 9/1979 | Hoskins et al. |
| 4,167,014 | A | | 9/1979 | Darling et al. |
| 4,509,057 | A | | 4/1985 | Sohl et al. |
| 4,523,201 | A | | 6/1985 | Liker |
| 4,535,339 | A | | 8/1985 | Horike et al. |
| 4,577,197 | A | | 3/1986 | Crean et al. |
| 4,612,553 | A | | 9/1986 | Kohler |
| 4,872,028 | A | | 10/1989 | Lloyd |
| 5,250,956 | A | | 10/1993 | Haselby et al. |
| 5,396,274 | A | | 3/1995 | Ortquist et al. |
| 5,448,269 | A | | 9/1995 | Beauchamp et al. |
| 5,534,895 | A | | 7/1996 | Lindenfelser et al. |
| 5,798,773 | A | * | 8/1998 | Hiramatsu et al. ..... 347/19 |
| 6,095,630 | A | | 8/2000 | Horii et al. |
| 6,109,721 | A | | 8/2000 | Kim |
| 6,164,745 | A | * | 12/2000 | Nagoshi et al. ..... 347/15 |
| 6,234,602 | B1 | | 5/2001 | Soto et al. |
| 6,293,644 | B1 | | 9/2001 | Markham et al. |
| 6,297,888 | B1 | | 10/2001 | Noyes et al. |
| 6,302,506 | B1 | | 10/2001 | Norton |
| 6,305,781 | B1 | | 10/2001 | Hull |
| 2001/0009429 | A1 | | 7/2001 | Soto et al. |
| 2001/0030671 | A1 | | 10/2001 | Fujimori |

FOREIGN PATENT DOCUMENTS

| | | |
|---|---|---|
| JP | 55003914 | 1/1980 |

* cited by examiner

*Primary Examiner*—Raquel Yvette Gordon
*Assistant Examiner*—Charles W. Stewart, Jr.
(74) *Attorney, Agent, or Firm*—Thompson Hine LLP; Scott N. Barker

(57) ABSTRACT

A method for determining ink drop velocity of a printhead located at a gap above a print medium. A first ink mark is printed at a first printhead velocity. A second ink mark is printed at a different (in magnitude and/or direction) second printhead velocity. The ink for the second ink mark is ejected from the printhead at the same print ejection position used for the first ink mark plus a predetermined offset distance (if any). The distance between the ink marks is measured. The ink drop velocity is calculated using the measured distance, the predetermined offset distance, the first and second printhead velocities, and the predetermined gap. In another method, an ink mark is printed, a distance is measured between the ink mark and the ink-ejection position, and the ink drop velocity is calculated using the measured distance, the printhead velocity, and the gap.

20 Claims, 2 Drawing Sheets

METHOD FOR DETERMINING INK DROP VELOCITY OF CARRIER-MOUNTED PRINTHEAD

TECHNICAL FIELD

The present invention relates generally to printing, and more particularly to a method for determining the ink drop velocity of a carrier-mounted printhead.

BACKGROUND OF THE INVENTION

Known printers include a printer, such as an inkjet printer, having a carrier-mounted printhead with print nozzles used to print ink on a print medium. The printhead carrier moves the printhead back and forth along a scanning axis at a predetermined gap above the print medium. Printing may be from left to right, from right to left or bidirectional (i.e., from left to right and from right to left). The print medium is advanced in a direction perpendicular to the scanning axis when the printhead has finished printing a scan line in one or more print passes.

The printhead is fired with enough energy to eject ink from the print nozzles at an ink drop velocity (defined to be the ink drop velocity relative to the printhead) having a direction along the ink ejection direction from the printhead to the print medium and having a magnitude typically in the range of 250 to 700 ips (inches per second) with 400 ips being an average number for a typical inkjet printer. From printhead lot to printhead lot, there are substantial variations in the amount of energy needed to attain this magnitude of the ink drop velocity. During printing, the ink drop velocity is assumed to have a particular magnitude. This assumed magnitude of the ink drop velocity is used to determine where the ink drop will land on the print medium if fired from a printhead having a predetermined gap and a known printhead carrier velocity.

This assumed magnitude of the ink drop velocity is often wrong. The effect is that ink drops do not land exactly where intended. It does not matter if the actual magnitude of the velocity is greater or less than the assumed magnitude; the net effect is still the same. Known printhead alignment procedures can compensate for some of this variation, but if the actual magnitude of the ink drop velocity could be determined, print quality could be enhanced. Known techniques for determining the ink drop velocity include measuring the time it takes for the ink drop to pass between two optical drop sensors spaced a predetermined distance apart above the print medium.

What is needed is an improved method for determining the ink drop velocity of a carrier-mounted printhead.

SUMMARY OF THE INVENTION

A first method of the invention is for determining the ink drop velocity of a carrier-mounted printhead located at a predetermined gap above a print medium and includes steps a) through d). Step a) includes printing a first ink mark on the print medium using the printhead with the printhead carrier moving along a scanning axis at a first printhead velocity. The printhead begins ejecting ink corresponding to the first ink mark at an ink-ejection position along the scanning axis. Step b) includes printing a second ink mark on the print medium using the printhead with the printhead carrier moving along the scanning axis at a second printhead velocity which is different from the first printhead velocity. The printhead begins ejecting ink corresponding to the second ink mark at the ink-ejection position plus a predetermined offset distance, and the second ink mark is spaced apart from the first ink mark. Step c) includes measuring the distance between the first and second ink marks. Step d) includes calculating the ink drop velocity using the measured distance, the predetermined offset distance, the first and second printhead velocities, and the predetermined gap.

A second method of the invention is for determining the ink drop velocity of a carrier-mounted printhead located at a predetermined gap above a print medium and includes steps a) through d). Step a) includes printing a first pattern of first ink marks on the print medium using the printhead with the printhead carrier moving along a scanning axis at a first printhead velocity. The printhead begins ejecting ink corresponding to the first ink marks at equally-spaced-apart ink-ejection positions along the scanning axis. Step b) includes printing a second pattern of second ink marks on the print medium using the printhead with the printhead carrier moving along the scanning axis at a second printhead velocity which is different from the first printhead velocity. The printhead begins ejecting ink corresponding to the second ink marks at the ink-ejection positions plus a predetermined offset distance, and the second ink marks are spaced apart from, and interleaved with, the first ink marks. Step c) includes measuring the distance between adjacent and ink-ejection-position-corresponding first and second ink marks using an optical reflective sensor mounted on the printhead carrier. Step d) includes calculating the ink drop velocity using the measured distance, the predetermined offset distance, the first and second printhead velocities, and the predetermined gap.

A third method of the invention is for determining the ink drop velocity of a carrier-mounted printhead located at a predetermined gap above a print medium and includes steps a) through c). Step a) includes printing an ink mark on the print medium using the printhead with the printhead carrier moving along a scanning axis at a printhead velocity. The printhead begins ejecting ink corresponding to the ink mark at an ink-ejection position along the scanning axis. Step b) includes measuring a distance between the ink-ejection position and the ink mark. Step c) includes calculating the ink drop velocity using the measured distance, the printhead velocity, and the predetermined gap.

Several benefits and advantages are derived from one or more of the methods of the invention. Measuring ink drop velocity will insure high quality printing with a more accurate placement of the ink drops on the print medium. In examples of the methods which use a printer's existing printhead-carrier-mounted auto-alignment optical reflective sensor in the distance measuring step, ink drop velocity can be measured without requiring additional printer hardware.

DETAILED DESCRIPTION

Figure 1:
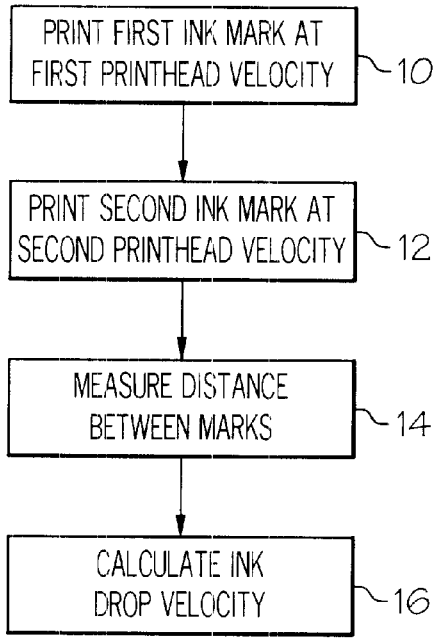
FIG. 1 is a block diagram of a first method of the invention.

A first method of the invention is for determining the ink drop velocity of a carrier-mounted printhead disposed at a predetermined gap above a print medium. Ink drop velocity is defined to be the ink drop velocity relative to the printhead. The first method is shown in block diagram form in FIG. 1 and includes steps a) through d). Step a) is labeled as "Print First Ink Mark At First Printhead Velocity" in block 10 of FIG. 1. Step a) includes printing a first ink mark on the print medium using the printhead with the printhead carrier moving along a scanning axis at a first printhead velocity, wherein the printhead begins ejecting ink corresponding to the first ink mark at an ink-ejection position along the scanning axis. Step b) is labeled as "Print Second Ink Mark At Second Printhead Velocity" in block 12 of FIG. 1. Step b) includes printing a second ink mark on the print medium using the printhead with the printhead carrier moving along the scanning axis at a second printhead velocity which is different from the first printhead velocity, wherein the printhead begins ejecting ink corresponding to the second ink mark at the ink-ejection position plus a predetermined offset distance, and wherein the second ink mark is spaced apart from the first ink mark. Step c) is labeled as "Measure Distance Between Marks" in block 14 of FIG. 1. Step c) includes measuring the distance between the first and second ink marks. Step d) is labeled as "Calculate Ink Drop Velocity" in block 16 of FIG. 1. Step d) includes calculating the ink drop velocity using the measured distance, the predetermined offset distance, the first and second printhead velocities, and the predetermined gap.

It is noted that the terms "first ink mark" and "second ink mark" in the first method are used merely to distinguish between two ink marks. For example, such terms do not require the first ink mark to have been printed in time before the second ink mark. Also, for example, such terms do not require the first ink mark to have been printed in space as first in position among a line of ink marks. In one embodiment, the ink marks are identical rectangular block ink marks. Other embodiments of identical or non-identical ink marks, including their sizes, shapes, and colors, are left to the artisan.

Figure 2:
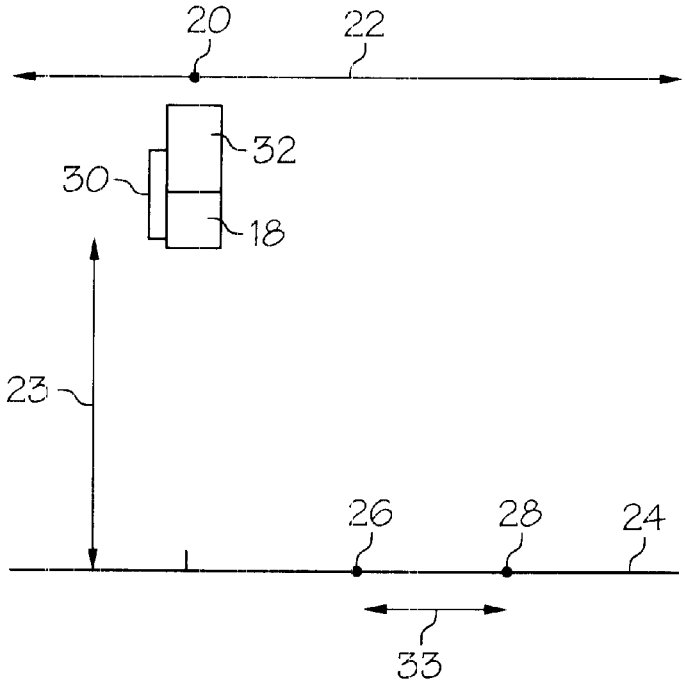
FIG. 2 is an explanatory diagram of an enablement of the first method showing the printhead at the ink-ejection position at a predetermined gap above a print medium, the first ink mark (in the form of a dot) on the print medium that will be made by the printhead when it is moving during a first print pass at the first printhead velocity (assumed to be at a lower speed from left to right), the second ink mark (in the form of a dot) on the print medium that will be made by the printhead during a second print pass when it is moving at the second printhead velocity (assumed to be at a higher speed from left to right), and wherein the predetermined offset distance is zero.

FIG. 2 is an explanatory diagram of an enablement of the first method and shows the printhead 18 at the ink-ejection position 20 along the scanning axis 22 at a predetermined gap 23 above a print medium 24. The first ink mark 26 is shown (in the form of a dot) on the print medium that will be made by the printhead when it is moving during a first print pass at the first printhead velocity (assumed to be at a lower speed from left to right). The second ink mark 28 is shown (in the form of a dot) on the print medium that will be made by the printhead during a second print pass when it is moving at the second printhead velocity (assumed to be at a higher speed from left to right). In this diagram, the predetermined offset distance is zero. An optical reflective sensor 30 is shown mounted on the printhead carrier 32. The distance 33 is the distance between the first and second ink marks and is measured by the optical reflective sensor 30 in a non-printing pass of the printhead carrier 32.

In one implementation of the first method, steps a) and b) are preformed without advancing the print medium between steps a) and b). In a different implementation, the print medium is advanced between steps a) and b) less than the height of the print swath of the printhead wherein an appropriately placed optical reflective sensor moving parallel to the scanning axis can be used to measure the distance between the first and second ink marks in step c).

In one example of the first method, step c) uses an optical reflective sensor mounted on the printhead carrier. Other types of sensors, whether they are mounted or not mounted to the printhead carrier, and other ways of measuring the distance in step c) are left to the artisan. In one variation, the optical reflective sensor is a printhead auto-alignment sensor. A printhead auto-alignment sensor is a sensor used by the printer to automatically calculate and correct for various printhead misalignments including, without limitation, horizontal misalignment between two printheads, vertical misalignment between two printheads, bidirectional misalignment of a printhead, and skew misalignment of a printhead, as is known to those skilled in the art. For printhead auto-alignment, the sensor moves across a printed test pattern of ink marks.

As an illustration, one known technique to determine bidirectional misalignment prints a plurality of rectangular blocks along the scanning axis with odd blocks printed from left to right and with even blocks printed from right to left with the intent of placing an even block exactly midway between two adjacent odd blocks. After printing, in one technique, the sensor is passed over the pattern to measure the distances between adjacent blocks (such as, without limitation, by using the position encoder of the printhead carrier or by using a timer and the known speed of the sensor). Unequal distances are a measure of bidirectional misalignment which, in one technique, is corrected for by advancing or delaying the firing times when printing right to left so that, in the case of the test pattern, the blocks from bidirectional printing are printed an equal distance apart.

It is noted that disabling any ink-drop-velocity corrections implemented within the firmware of the printer controller during the performance of the first method will improve the accuracy of the method in determining the ink drop velocity. Such disabled corrections include any alignment and/or timing adjustments used to correct ink drop placement. When the ink drop velocity has been measured by the method, it can be used as a reference velocity for automatic ink drop velocity adjustment as can be appreciated by the artisan.

A velocity has a magnitude (speed) and a direction. The direction of the ink drop velocity is along the ink ejection direction from the printhead to the print medium. In one enablement of the first method, the first printhead velocity has a first magnitude and a first direction along the scanning, axis, and the second printhead velocity has a second magnitude and a second direction along the scanning axis.

In a first variation, the second magnitude is different from the first magnitude, and the second direction is identical to the first direction. One illustration of the first variation is having the first ink mark printed from left to right at a slower quality-mode printhead carrier speed and having the second ink mark printed from left to right at a faster draft-mode printhead carrier speed as shown in FIG. 2. In a second variation, the second magnitude is different from the first magnitude, and the second direction is opposite to the first direction. One illustration of the second variation is having the first ink mark printed from left to right at a slower quality-mode printhead carrier speed and having the second ink mark printed from right to left at a faster draft-mode printhead carrier speed.

In a third variation, the second magnitude is identical to the first magnitude, and the second direction is opposite to the first direction. In one modification of the third variation, the first magnitude is equal to the maximum speed of the printhead carrier. One illustration of this modification is having the first ink mark printed from left to right at the maximum printhead carrier speed and having the second ink mark printed from right to left at the same maximum printhead carrier speed. This illustration results in the greatest distance between the first and second ink marks. This results in the greatest accuracy for determining the ink drop velocity, when a sensor is used for the distance measurement which measures in finite increments, as can be appreciated by those skilled in the art.

In one application of the first method, the predetermined offset distance is zero. In a different application of the first method, the predetermined offset distance is a finite distance chosen for proper spacing apart of the first and second ink marks, as is within the ordinary level of skill of the artisan. In one use of the first method, the first and second ink marks each have a substantially identically rectangular block shape. Examples of other ink mark shapes are left to the artisan as is the use of a second ink mark which is different in size and/or shape from the first ink mark.

Known algorithms to measure the distance between identical first and second rectangular-block ink marks, using an optical reflective sensor mounted on the printhead carrier include, using analog or digital techniques, measuring: the distance between the trailing edge of the first mark and the leading edge of the second mark; the distance between the leading edges of the marks minus the predetermined length of the first mark, the distance between the trailing edges of the marks minus the predetermined length of the second mark, and the distance between the centers of the marks having determined the centers from the mark edges. Known ways to measure distance include: counting the "zeros" of no signal returns and the "ones" of signal returns for a digital sensor knowing its sampling rate and the speed of the moving sensor; and using a timer and the speed of the moving sensor to detect changes in the return signal for an analog sensor to find the edges of the marks. Other algorithms and ways to measure distance are left to the artisan.

One equation is $V=d(CV2-CV1)/(Ym-Yp)$ for use in step d) of the first method. In this equation: V is the magnitude of the ink drop velocity; d is the predetermined gap between the printhead and the print medium; CV2 is the second printhead velocity; CV1 is the first printhead velocity; Ym is the measured distance between the adjacent and ink-ejection-position-corresponding first and second ink marks; and Yp is the predetermined offset distance. In this equation: CV2 is larger in magnitude than CV1; CV2 is defined to be a positive number; and CV1 is defined to be a positive number if the printhead carrier moved, in the same direction for the printing of the first and second ink marks and is defined to be a negative number if the printhead carrier moved in opposite directions for the printing of the first and second ink marks. Ym is defined to be a positive number. Yp is defined to be a positive number if the first printhead velocity, the second printhead velocity and the predetermined offset are all in the same direction or if the second printhead velocity and the predetermined offset are in the same direction opposite to the direction of the first printhead velocity. Otherwise, Yp is defined to be a negative number. In one usage of the first method, Yp is zero. In another usage of the first method, Yp is nonzero such as, in one example, when extra spacing is needed to separate the first and second ink marks. Other equations for use in step d) are left to the artisan.

In one execution of the first method, a printhead-carrier position encoder is used to signal that the ink ejection position in steps a) and b) has been reached for the printhead to print the first and second ink marks, but the printhead-carrier position encoder is not used in step c) in measuring the distance between the first and second ink marks. Other techniques for locating the ink ejection position are left to the artisan.

Figure 3:
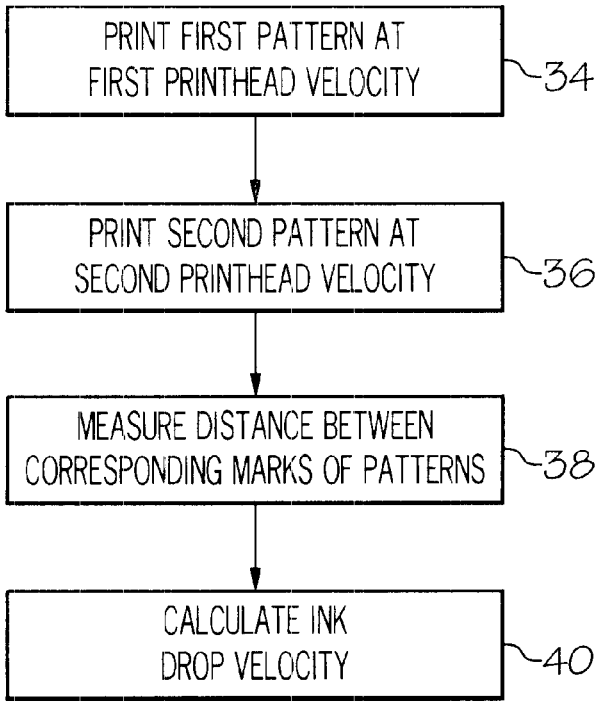
FIG. 3 is a block diagram of a second method of the invention.

A second method of the invention is for determining the ink drop velocity of a carrier-mounted printhead disposed at a predetermined gap above a print medium. As previously mentioned, ink drop velocity is defined to be the ink drop velocity relative to the printhead. The second method is shown in block diagram form in FIG. 3 and includes steps a) through d). Step a) is labeled as "Print First Pattern At First Printhead Velocity" in block 34 of FIG. 3. Step a) includes printing a first pattern of first ink marks on the print medium using the printhead with the printhead carrier moving along a scanning axis at a first printhead velocity, wherein the printhead begins ejecting ink corresponding to the first ink marks at equally-spaced-apart ink-ejection positions along the scanning axis. Step b) is labeled as "Print Second Pattern At Second Printhead Velocity" in block 36 of FIG. 3. Step b) includes printing a second pattern of second ink marks on the print medium using the printhead with the printhead carrier moving along the scanning axis at a second printhead velocity which is different from the first printhead velocity, wherein the printhead begins ejecting ink corresponding to the second ink marks at the ink-ejection positions plus a predetermined offset distance, and wherein the second ink marks are spaced apart from, and interleaved with, the first ink marks. It is noted that the terms "first ink marks" and "second ink marks" in the second method are used merely to distinguish between two patterns of ink marks. Step c) is labeled as "Measure Distance Between Corresponding Marks Of Patterns" in block 38 of FIG. 3. Step c) includes measuring the distance between adjacent and ink-ejection-position-corresponding first and second ink marks using an optical reflective sensor mounted on the printhead carrier. Step d) is labeled as "Calculate Ink Drop Velocity" in block 40 of FIG. 3. Step d) includes calculating the ink drop velocity using the measured distance, the predetermined offset distance, the first and second printhead velocities, and the predetermined gap. Appropriate examples, etc. of the first method are applicable as examples, etc. of the second method as can be appreciated by the artisan.

In one example of the second method, the first printhead velocity has a first magnitude and a first direction along the scanning axis, and the second printhead velocity has a second magnitude and a second direction along the scanning axis. In this example, the second magnitude is identical to the first magnitude, and the second direction is opposite to the first direction. In one variation, the first magnitude is equal to the maximum speed of the printhead carrier.

It is noted that measurement accuracy in step c) is increased by using known averaging techniques when the first pattern includes more than one first mark and the second pattern includes more than one second mark, as can be appreciated by those skilled in the art.

One equation is $V=d(2\ Vm)/(Ym-Yp)$ for use in step d) of the second method when the first and second printhead velocities have opposite directions and have equal magnitudes equal to the maximum speed of the printhead carrier. In this equation: V is the magnitude of the ink drop velocity; d is the predetermined gap between the printhead and the print medium; Vm is the maximum speed of the printhead carrier, Ym is the measured distance between the adjacent and ink-ejection-position-corresponding first and second ink marks; and Yp is the predetermined offset distance. Vm and Ym are defined to be positive numbers. Yp is defined to be a positive number if the second printhead velocity and the predetermined offset have the same direction and is defined to be a negative number if the second printhead velocity and the predetermined offset have opposite directions. In one usage of the second method, Yp is zero. In another usage of the first method, Yp is nonzero such as, in one example, when extra spacing is needed to separate the first and second ink marks. Other equations are left to the artisan. In one variation, the first and second ink marks each have a substantially identically rectangular block shape.

Figure 4:
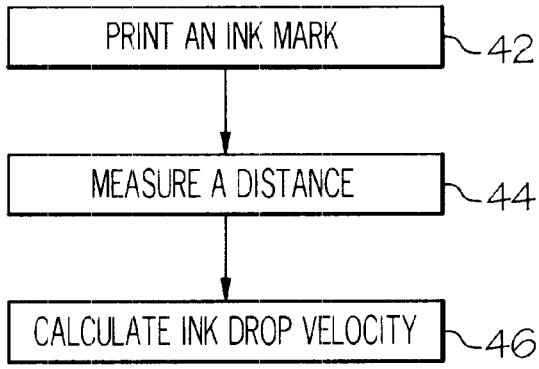
FIG. 4 is a block diagram of a third method of the invention.

A third method of the invention is for determining the ink drop velocity of a carrier-mounted printhead disposed at a predetermined gap above a print medium. As previously mentioned, ink drop velocity is defined to be the ink drop velocity relative to the printhead. The third method is shown in block diagram form in FIG. 4 and includes steps a) through c). Step a) is labeled as "Print An Ink Mark" in block 42 of FIG. 4. Step a) includes printing an ink mark on the print medium using the printhead with the printhead carrier moving along a scanning axis at a printhead velocity, wherein the printhead begins ejecting ink corresponding to the ink mark at an ink-ejection position along the scanning axis. Step b) is labeled as "Measure A Distance" in block 44 of FIG. 4. Step b) includes measuring a distance between the ink-ejection position and the ink mark. Step c) is labeled as "Calculate Ink Drop Velocity" in block 46 of FIG. 4. Step d) includes calculating the ink drop velocity using the measured distance, the printhead velocity and the predetermined gap. Appropriate examples, etc. of the first and/or second methods and/or the print patterns of the second method are applicable as examples, etc. of, and/or optional print patterns for, the third method as can be appreciated by the artisan.

One equation is V=d(VC1)/Y1 for use in step c) of the third method. In this equation: V is the magnitude of the ink drop velocity, d is the predetermined gap between the printhead and the print medium, VC1 1 is the speed of the printhead, and Y1 is the measured distance between the ink-ejection position and the ink mark. VC1 and Y1 are defined to be positive numbers. Other equations are left to the artisan.

In one execution of the third method, a printhead-carrier position encoder is used to signal that the ink ejection position in step a) has been reached for the printhead to print the ink mark and is also used to signal that the ink ejection position in step b) has been reached in a non-printing pass of the printhead carrier for a printhead-carrier-mounted optical reflective sensor to measure the distance between the ink ejection position and the ink mark. Other techniques for locating the ink ejection position are left to the artisan.

In one extension of the third method, step a) also includes printing additional ink marks at the printhead velocity wherein the printhead begins ejecting ink corresponding to the additional ink marks at additional ink-ejection positions along the scanning axis. Step b) also includes measuring additional distances between the additional ink-ejection positions and the corresponding additional ink marks. Step c) also includes calculating the ink drop velocity also using the measured additional distances. In one variation, step c) also averages the measured distance and the measured additional distances, as can be appreciated by the artisan.

Several benefits and advantages are derived from one or more of the methods of the invention. Measuring ink drop velocity will insure high quality printing with a more accurate placement of the ink drops on the print medium. In examples of the methods which use a printer's existing printhead-carrier-mounted auto-alignment optical reflective sensor in the distance measuring step, ink drop velocity can be measured without requiring additional printer hardware.

The foregoing description of several methods of the invention has been presented for purposes of illustration. It is not intended to be exhaustive or to limit the invention to the precise procedures disclosed, and obviously many modifications and variations are possible in light of the above teaching. It is intended that the scope of the invention be defined by the claims appended hereto.

What is claimed is:

1. A method for determining the ink drop velocity of a carrier-mounted printhead disposed at a predetermined gap above a print medium comprising the steps of:

a) printing a first ink mark on the print medium using the printhead with the printhead carrier moving along a scanning axis at a first printhead velocity, wherein the printhead begins ejecting ink corresponding to the first ink mark at an ink-ejection position along the scanning axis;

b) printing a second ink mark on the print medium using the printhead with the printhead carrier moving along the scanning axis at a second printhead velocity, having a second magnitude and a second direction along the scanning axis, which is different from the first printhead velocity, wherein the printhead begins ejecting ink corresponding to the second ink mark at the ink-ejection position plus a predetermined offset distance, and wherein the second ink mark is spaced apart from the first ink mark;

c) measuring the distance between the first and second ink marks; and d) calculating the ink drop velocity using the measured distance, the predetermined offset distance, the first and second printhead velocities, and the predetermined gap.

2. The method of claim 1, wherein steps a) and b) are performed without advancing the print medium between steps a) and b).

3. The method of claim 1, wherein step c) uses an optical reflective sensor mounted on the printhead carrier.

4. The method of claim 3, wherein the optical reflective sensor is a printhead auto-alignment sensor.

5. The method of claim 1, wherein the first printhead velocity has a first magnitude and a first direction along the scanning axis, and wherein the second printhead velocity has a second magnitude and a second direction along the scanning axis.

6. The method of claim 1, wherein the second magnitude is different from the first magnitude.

7. The method of claim 6, wherein the second direction is identical to the first direction.

8. The method of claim 6, wherein the second direction is opposite to the first direction.

9. The method of claim 1, wherein the second magnitude is identical to the first magnitude, and wherein the second direction is opposite to the first direction.

10. The method of claim 9, wherein the first magnitude is equal to the maximum speed of the printhead carrier.

11. The method of claim 1, wherein the predetermined offset distance is zero.

12. The method of claim 1, wherein the first and second ink marks each have a substantially identically rectangular block shape.

13. The method of claim 1, wherein step d) calculates the ink drop velocity magnitude V using the equation V=d (CV2−CV1)/(Ym−Yp), wherein d is the predetermined gap between the printhead and the print medium, CV2 is the second printhead velocity, CV1 is the first printhead velocity, Ym is the measured distance between the adjacent and ink-ejection-position-corresponding first and second ink marks, and Yp is the predetermined offset distance, wherein CV2 is larger in magnitude than CV1, wherein CV2 is defined to be a positive number, and wherein CV1 is defined to be a positive number if the printhead carrier moved in the same direction for the printing of the first and second ink marks and is defined to be a negative number if the printhead carrier moved in opposite directions for the printing of the first and second ink marks.

14. A method for determining the ink drop velocity of a carrier-mounted printhead disposed at a predetermined gap above a print medium comprising the steps of:

a) printing a first pattern of first ink marks on the print medium using the printhead with the printhead carrier moving along a scanning axis at a first printhead velocity, wherein the printhead begins ejecting ink corresponding to the first ink marks at equally-spaced-apart ink-ejection positions along the scanning axis;

b) printing a second pattern of second ink marks on the print medium using the printhead with the printhead carrier moving along the scanning axis at a second printhead velocity which is different from the first printhead velocity, wherein the printhead begins ejecting ink corresponding to the second ink marks at the ink-ejection positions plus a predetermined offset distance, and wherein the second ink marks are spaced apart from, and interleaved with, the first ink marks;

c) measuring the distance between adjacent and ink-ejection-position-corresponding first and second ink marks using an optical reflective sensor mounted on the printhead carrier; and d) calculating the ink drop velocity using the measured distance, the predetermined offset distance, the first and second printhead velocities, and the predetermined gap.

15. The method of claim 14, wherein the second magnitude is identical to the first magnitude, wherein the second direction is opposite to the first direction.

16. The method of claim 15, wherein the first magnitude is equal to the maximum speed of the printhead carrier.

17. The method of claim 16, wherein step d) calculates the ink drop velocity magnitude V using the equation V=d (2Vm)/(Ym−Yp), wherein d is the predetermined gap between the printhead and the print medium, Vm is the maximum speed of the printhead carrier, Ym is the measured distance between the adjacent and ink-ejection-position-corresponding first and second ink marks, and Yp is the predetermined offset distance.

18. The method of claim 17, wherein the first and second ink marks each have a substantially identically rectangular block shape.

19. A method for determining the ink drop velocity: of a carrier-mounted printhead disposed at a predetermined gap above a print medium comprising the steps of:

a) printing an ink mark on the print medium using the printhead with the printhead carrier moving along a scanning axis at a printhead velocity, wherein the printhead begins ejecting ink corresponding to the ink mark at an ink-ejection position along the scanning axis;

b) measuring a distance between the ink-ejection position and the ink mark; and c) calculating the ink drop velocity using the measured distance, the printhead velocity, and the predetermined gap.

20. The method of claim 19, wherein step c) calculates the ink drop velocity magnitude V using the equation V=d (VC1)/Y1, wherein d is the predetermined gap between the printhead and the print medium, VC1 is the speed of the printhead, and Y1 is the measured distance between the ink-ejection position and the ink mark.

* * * * *